US006741034B2

(12) United States Patent
Scholz

(10) Patent No.: US 6,741,034 B2
(45) **Date of Patent: *May 25, 2004**

(54) STARTING AID FOR HIGH INTENSITY DISCHARGE LAMP

(75) Inventor: John A. Scholz, Georgetown, MA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/225,989

(22) Filed: Aug. 22, 2002

(65) Prior Publication Data

US 2004/0036416 A1 Feb. 26, 2004

(51) Int. Cl.[7] ..... H01J 17/18

(52) U.S. Cl. ..... 313/623; 313/631; 313/634; 313/638; 313/601; 313/238; 313/244; 313/251; 315/56; 315/344

(58) Field of Search ..... 313/623, 631, 313/634, 638, 238, 244, 251, 601; 315/56, 344

(56) References Cited

U.S. PATENT DOCUMENTS 5,323,091 A * 6/1994 Morris ..... 315/344
6,198,223 B1 * 3/2001 Scholz ..... 313/623
6,249,077 B1 * 6/2001 Brown et al. ..... 313/25
6,628,080 B1 * 9/2003 McCullough et al. ..... 315/56

* cited by examiner

*Primary Examiner*—Nimeshkumar D. Patel
*Assistant Examiner*—Sikha Roy
(74) *Attorney, Agent, or Firm*—William E. Meyer

(57) ABSTRACT

A lamp assembly that comprises a hollow arc discharge light source having a center arc chamber containing an arc generating and sustaining medium and first and second ends with an electrode receiving capillary extending from each end and arrayed along a longitudinal axis. The ends are cylindrical in cross-section. An electrode structure is positioned in each of the capillaries and each of these electrode structures comprises a proximal electrode end projecting into the interior of the center arc chamber, a distal end projecting exteriorly of said capillary and an intermediate section therebetween. A first area of the intermediate section is sealed to the capillary in an hermetic manner and a second area of the intermediate section is exposed to the medium. A tubular shroud surrounds the light source and is coaxial with the longitudinal axis. The shroud has two ends. A pair of spring clips, one at each end of said shroud, mount the light source within the shroud. Each of the spring clips comprises a base in a first plane and has an aperture centrally located therein, each aperture of one of the spring clips frictionally engaging one of the cylindrical ends of the light source at a position adjacent the second area of the intermediate section. Both spring clips are electrically connected to a frame, which is electrically to one of the electrode structures.

3 Claims, 2 Drawing Sheets

STARTING AID FOR HIGH INTENSITY DISCHARGE LAMP

TECHNICAL FIELD

This invention relates to starting aids and more particularly to starting aids for high intensity discharge lamps. It has particular application to high intensity discharge lamps utilizing ceramic arc tubes.

BACKGROUND ART

Arc discharge lamps require a ballast for operation. The ballast supplies the requisite open circuit voltage to start and maintain an arc in the discharge tube as well as limiting the current through the discharge tube. One type of ballast uses a high voltage pulse to initiate breakdown in the discharge tube. Arc tube breakdown is the first phase of lamp starting and is therefore essential for lamp operation. The typical high voltage pulse for a ballast of this type has an amplitude between three and four kilovolts (KV) with a pulse width of 1.0 $\mu$s at 2.7 KV. There are two commercial ballast methods for applying the typical voltage to the lamp. The first method applies the pulse voltage to the center contact of the lamp base; and the second method divides the pulse between the center contact and the shell of the base. The second method, referred to as the split lead design, has an unusual characteristic, floating the lamp lead wires such that both lamp wires carry pulse voltage with respect to ground. When the pulse voltage is applied to the lamp, 1.7 KV is applied to the center contact of the lamp and an opposite potential of approximately equal magnitude is applied to the shell of the lamp base.

There is now available a relatively new type of ceramic arc tube that utilizes a design that contains essentially three distinct sections. See, for example, U.S. Pat. Nos. 4,795,943, 5,424,609, 6,004,503 and 5,993,725. The three sections are: the main, central body or arc chamber where the discharge takes place and two legs, one on either side of the body, which contain the electrode structure and the lead-ins therefor. The electrode structure comprises an external lead, an internal lead and an electrode. The internal lead connects the external lead to the electrode that is located within the arc chamber. The arc chamber, of course, also houses the arc generating and sustaining medium. The arc chamber, and thus the medium, continues partway into each of the opposed legs that contain the electrode structure.

One of the characteristic advantages of the preformed and pre-sized ceramic arc tubes over their quartz predecessors is the consistent lamp-to-lamp geometry. This geometric uniformity results in consistent heat transfer mechanisms and consistent radiation from the arc tube. This consistency greatly enhances lamp performance. Such lamps are observed to have minimum lamp-to-lamp variations of color temperature, lumen output and color rendering index.

It is often necessary to use a glow bottle in addition to a ballast that supplies high voltage to start discharge lamps. These glow bottles comprise a hermetically sealed capsule, usually of quartz, which contain a partial pressure (i.e., <1 atmosphere) of argon, nitrogen or other gas mixtures. They may additionally contain a partial pressure of mercury. These glow bottles contain an additional lead-in that facilitates the "glow" or ionization of their contained gases when a sufficient potential is applied to the glow bottle lead-in. The glass vessel of the glow bottle must be in close proximity to a lead-in of the opposite potential for the ionization of the enclosed gas to occur. Upon energization of the glow bottle, UV is generated, which UV initiates the arc discharge in the lamp. Such glow bottles are shown in U.S. Pat. No. 4,818,915.

The use of glow bottles, while effective, adds to the cost of the lamp and, furthermore, is generally not possible to use with a ceramic arc tube. Such ceramic arc tubes are usually encased in an aluminosilicate shroud that closely surrounds the arc tube leaving insufficient room to allow adequate placement of the glow bottle. Also, since the aluminosilicate shroud is an effective absorber of UV radiation, it is not effective to place a glow bottle outside of the shroud.

Further, since the environment between the inside of the outer jacket and the arc tube may be a vacuum when a ceramic arc tube is employed, it may not be possible to use that environment as a source of UV radiation to enhance starting.

Other methods that are being employed to facilitate lamp starting use hazardous materials such as radioactive krypton 85 and it would be a distinct advance in the art to avoid the use of such materials.

DISCLOSURE OF INVENTION

It is, therefore, an object of the invention to obviate the disadvantages of the prior art.

It is another object of the invention to enhance starting aids.

It is yet another object of the invention to reduce the cost of starting aids and the cost of the lamps employing the same.

These objects are accomplished, in one aspect of the invention by a lamp assembly that comprises a hollow arc discharge light source having a center arc chamber containing an arc generating and sustaining medium and first and second ends with an electrode receiving capillary extending from each end and arrayed along a longitudinal axis. The ends are cylindrical in cross-section. An electrode structure is positioned in each of the capillaries and each of these electrode structures comprises a proximal electrode end projecting into the interior of the center arc chamber, a distal end projecting exteriorly of the capillary and an intermediate section therebetween. A first area of the intermediate section is sealed to the capillary in an hermetic manner and a second area of the intermediate section is exposed to the medium.

A tubular shroud surrounds the light source and is coaxial with the longitudinal axis. The shroud has two ends. A pair of spring clips, one at each end of said shroud, mount the light source within the shroud. Each of the spring clips comprises a base in a first plane and has an aperture centrally located therein, each aperture of one of the spring clips engaging one of the cylindrical ends of the light source at a position adjacent the second area of the intermediate section.

BEST MODE FOR CARRYING OUT THE INVENTION

For a better understanding of the present invention, together with other and further objects, advantages and capabilities thereof reference is made to the following disclosure and appended claims in conjunction with the above-described drawings.

Figure 1:
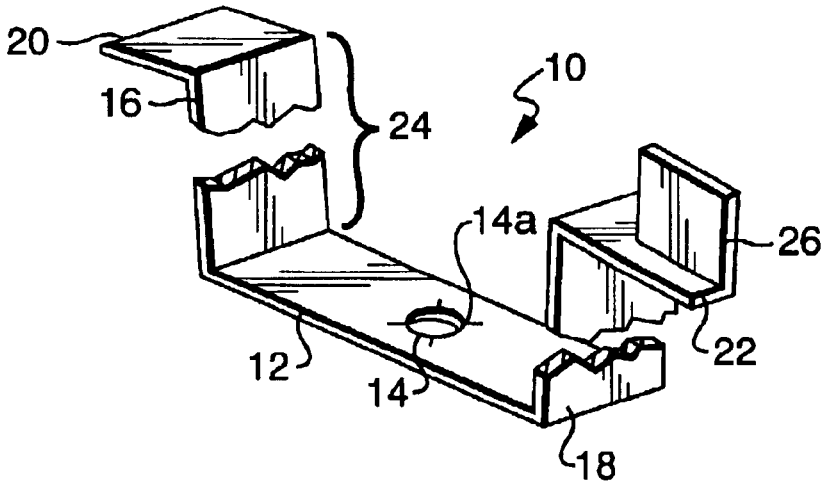
FIG. 1 is a perspective view of a spring clip used with the invention.

Referring now to the drawings with greater particularity, there is shown in FIG. 1 a spring clip 10 comprising a base 12 extending in a first plane and having an aperture 14 centrally located therein. Aperture 14 is substantially circular and is provided with cutouts 14*a* to provide flexibility. Upstanding walls 16, 18, are provide, one at each end of the base 12.

A first lip 20 extends orthogonally away from the wall 16 in a second plane and a second lip 22 extends orthogonally away from the wall 18, also in the second plane. The second plane is substantially parallel to the first plane but spaced therefrom by a given distance 24, the importance of which will be explained below. A flag 26 is formed with the lip 22 and extends away from the lip in a plane transverse to the first and second planes.

Figure 2:
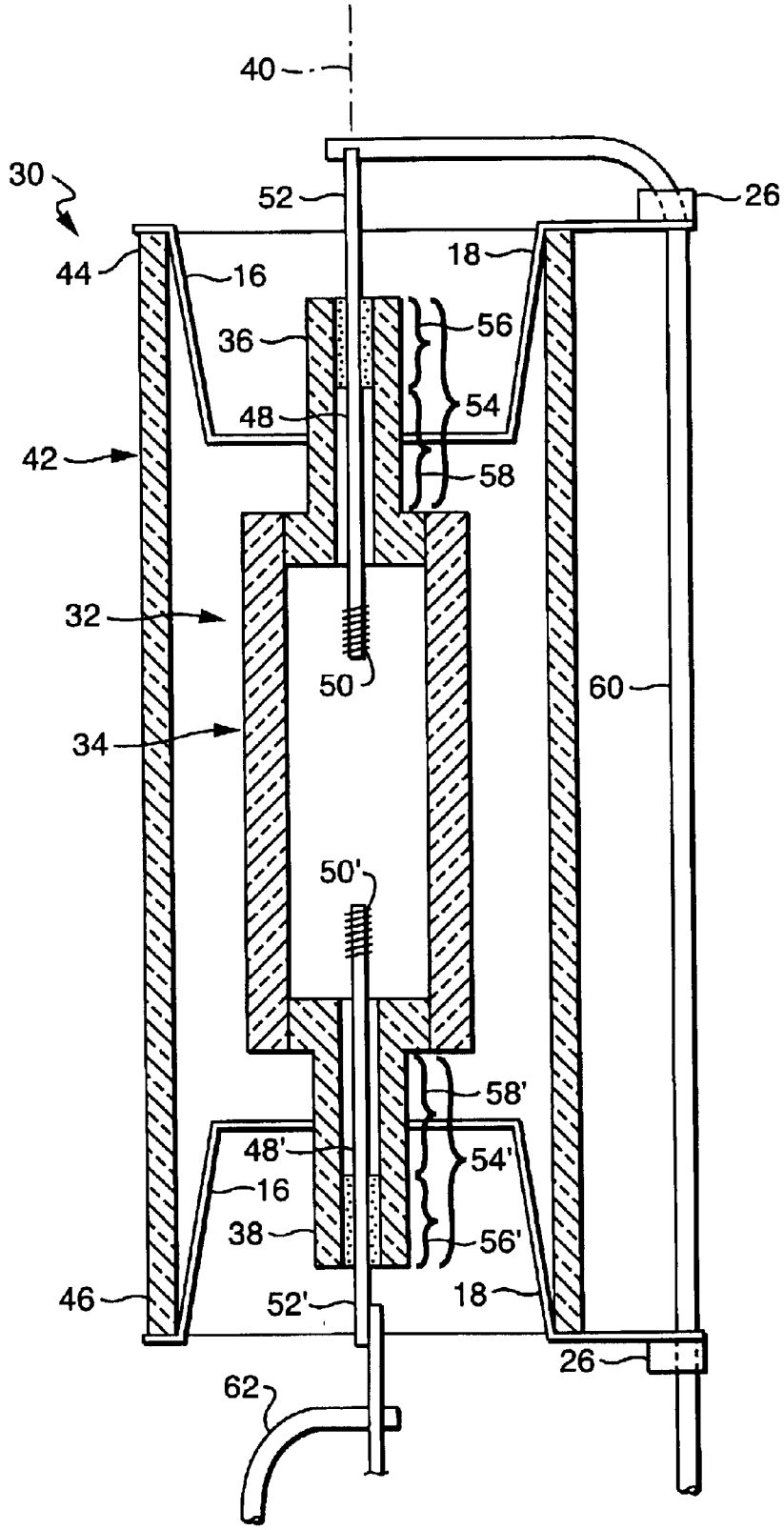
FIG. 2 is a sectional view of the lamp assembly.

Referring now to FIG. 2, there is shown an assembly 30 for a lamp comprising a light source 32 having a center section 34 and projecting, opposite, electrode receiving capillary ends 36, 38 arrayed along a longitudinal axis 40. The ends are cylindrical in cross-section. In a preferred embodiment of the invention the light source 32 is an arc tube formed of a metal oxide such as sapphire or polycrystalline alumina ($Al_2O_3$). Additionally, a metal nitride such as aluminum nitride (AlN) or a metal oxy-nitride such as aluminum oxynitride (AlON) can be employed.

A tubular shroud 42 surrounds the light source 32 and is coaxial with the longitudinal axis 40. The shroud has two ends 44, 46.

A pair of spring clips 10 is provided, one at each end 44, 46 of the shroud 40, to support the light source 32 within the shroud.

The light source 32 is shown as being cylindrical; however, other configurations are possible, including a bulgy shape such as is shown in U.S. patent application Ser. No. 10/128,866, now U.S. Pat. No. 6,628,080.

An electrode structure 48 is positioned in one of the capillaries and an electrode structure 48' is positioned in the other of the capillaries. Each of the electrode structures comprises a proximal electrode end 50, 50' projecting into the interior of the center arc chamber, a distal end 52, 52' projecting exteriorly of the capillary and an intermediate section 54, 54' therebetween. A first area 56, 56' of the intermediate sections is sealed to the capillary in an hermetic manner and a second area 58, 58' of the intermediate sections 54, 54' is exposed to the medium.

To assemble the light source in the shroud, the clips 10 are positioned on the cylindrical ends 36 and 38 of the light source by fitting the ends 36, 38 through an aperture 14 and positioning the clips at an appropriate distance along the length of the ends so that the lips contact, or are in close proximity to, the ends in the second area 58, 58'. It is because the clips 10 are in contact or close proximity to the second area that the length 24 is important. This length must allow the clip to reach the proximity of the second area, and preferably be in contact with the second area, for the clip to function as a starting aid.

One of the clips 10 is then manually compressed by bending the lips 20 and 22 inwardly toward each other until the distance between them is smaller than the internal diameter of the shroud being employed. The clip, and its associated light source, is then pushed into the shroud where it will elastically unfold when it reaches the required insertion distance; that is, when the lips 20 and 22 exit the open end, for example, end 44, of the shroud. At the same time, the second, or bottom clip is also in its final position at the end 46 of the shroud.

Alternatively, a clip can be positioned on one end of a capillary at the required distance and a shroud positioned over the light source. The second clip can then be positioned at the other end of the light source. Preferably, a fastening aid or jig is used to maintain proper alignment and positioning.

This action completes the assembly 30, which can now be attached to a suitable frame 60, as is shown in FIG. 2. The frame 60 can comprise a first electrical lead-in, which provides electrical connection to distal end 52 of electrode structure 48. A second electrical lead-in 62 provides electrical connection to the other distal end 52' of electrode structure 48'.

Since one of the clips 24 is positioned in second area 58' of electrode structure 48' and since the clip is attached to frame 60 which connects to electrode structure 48, a capacitively coupled ionization mechanism is performed in the leg of the arc when power is applied to the lamp assembly.

The use of the arc tube mounting member as a starting aid greatly simplifies the assembly of the lamp and reduces the cost tremendously. The number of welds necessary to complete the mount is also greatly reduced which contributes to a further reduction in cost.

While there have been shown and described what are at present considered to be the preferred embodiments of the invention, it will be apparent to those skilled in the art that various changes and modification can be made herein without departing from the scope of the invention as defined by the appended claims.

What is claimed is:

1. A lamp comprising:

a hollow arc discharge light source having a center arc chamber containing an arc generating and sustaining medium and first and second ends;

an electrode receiving capillary extending from each end and arrayed along a longitudinal axis, said ends being cylindrical in cross-section;

an electrode structure positioned in each of said capillaries, each of said electrode structures comprising a proximal electrode end projecting into the interior of said center arc chamber, a distal end projecting exteriorly of said capillary and an intermediate section therebetween, a first area of said intermediate section being sealed to said capillary in an hermetic manner and a second area of said intermediate section being exposed to said medium;

a tubular shroud surrounding said light source coaxial with said longitudinal axis, said shroud having two ends, the improvement comprising;

a pair of spring clips, one at each end of said shroud, mounting said light source within said shroud, each of said spring clips comprising a base in a first plane and having an aperture centrally located therein, each aperture of one of said spring clips engaging one of said cylindrical ends of said light source at a position adjacent said second area of said intermediate section.

2. The lamp assembly of claim 1 wherein said spring clips further comprise:

upstanding walls, one at each end of said base, said walls lying adjacent to the interior surface of said shroud and at least a part of each of said walls frictionally engaging said interior surface;

a first lip extending orthogonally away from said wall in a second plane;

a second lip extending orthogonally away from said wall in said second plane, said second plane being substantially parallel to said first plane, said lips engaging an end of said shroud: and flags formed, respectively with said lips, said flags extending away from said lips in a plane transverse to said first and second planes.

3. The lamp assembly of claim 2 wherein said assembly is provided with first and second electrical lead-ins, said first electrical lead-in being connected to a first of said electrode structures, said second electrical lead-in being connected to the other of said electrode structures and both of said pair of spring clips being mechanically and electrically connected to said first electrical lead-in.

* * * * *